US007129895B2

(12) United States Patent
Morris et al.

(10) Patent No.: US 7,129,895 B2
(45) Date of Patent: Oct. 31, 2006

(54) MULTIBAND CONCENTRIC MAST AND MICROSTRIP PATCH ANTENNA ARRANGEMENT

(75) Inventors: Daniel G. Morris, Ovid, MI (US); Korkut Yegin, Grand Blanc, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/989,201

(22) Filed: Nov. 15, 2004

(65) Prior Publication Data

US 2006/0103581 A1 May 18, 2006

(51) Int. Cl.
*H01Q 1/38* (2006.01)
*H01Q 5/01* (2006.01)

(52) U.S. Cl. ..... 343/700 MS; 343/725

(58) Field of Classification Search ..... 343/700 MS, 343/715, 725, 727, 846
See application file for complete search history.

(56) References Cited

U.S. PATENT DOCUMENTS 3,946,390 A * 3/1976 Alexander et al. ..... 343/702
5,654,717 A * 8/1997 Nichols et al. ..... 342/357.06
5,831,577 A 11/1998 Nichols et al. ..... 342/357

FOREIGN PATENT DOCUMENTS

EP 1 249 892 10/2002
EP 1 367 669 12/2003

OTHER PUBLICATIONS

European Search Report dated Feb. 15, 2006.

* cited by examiner

*Primary Examiner*—Michael C. Wimer
(74) *Attorney, Agent, or Firm*—Jimmy L. Funke

(57) ABSTRACT

An antenna module incorporates a microstrip patch antenna and a mast antenna in an at least substantially concentric arrangement for communicating signals in multiple communication bands. The output signals from the microstrip patch antenna and the mast antenna are output via a single RF cable. The antenna module can be used to communicate signals in multiple communication bands, including both satellite and terrestrial communications. The antenna module conserves space, while avoiding unacceptable distortion of radiation patterns for satellite services. In addition, the mast antenna can be implemented using a thinner, more flexible construction than certain conventional solutions. Further, providing the outputs from the antennas via a single RF cable may facilitate collocating tuners for multiple communication services, resulting in considerable size and cost savings by using a single set of RF cables and connectors.

14 Claims, 5 Drawing Sheets

MULTIBAND CONCENTRIC MAST AND MICROSTRIP PATCH ANTENNA ARRANGEMENT

TECHNICAL FIELD

This disclosure relates generally to antennas. More particularly, the disclosure relates to antennas for use in receiving satellite-broadcast signals.

BACKGROUND OF THE DISCLOSURE

The vast majority of vehicles currently in use incorporate vehicle communication systems for receiving or transmitting signals. For example, vehicle audio systems provide information and entertainment to many motorists daily. These audio systems typically include an AM/FM radio receiver that receives radio frequency (RF) signals. These RF signals are then processed and rendered as audio output. A vehicle communication system may incorporate other functions, including, but not limited to, wireless voice and data communications, global positioning system (GPS) functionality, satellite-based digital audio radio service (SDARS) functionality, keyless entry, and remote vehicle starting.

Communication systems, including vehicle communication systems, typically employ antenna systems including one or more antennas to receive or transmit electromagnetic radiated signals. In general, such antenna systems have predetermined patterns and frequency characteristics. These predetermined characteristics are selected in view of various factors, including, for example, the ideal antenna design, physical antenna structure limitations, and mobile environment requirements.

Some antenna modules incorporate multiple antennas for use in different applications, including cellular telephony in the AMPS, PCS, and GSM communication bands, digital audio broadcast (DAB), GPS, and SDARS systems. These antennas can be stacked or placed on the same circuit board, for example, arranged adjacent to one another in a row.

One type of antenna, known as an antenna mast, is commonly used in high frequency communications. For example, antenna masts may be used in wireless voice and data communications systems operating at frequencies up to and even in excess of 1 GHz. An antenna mast may be implemented, for example, as a flexible fiberglass or TEFLON® rod with a helically-wound conductor for receiving radio signals.

Small mast antennas, such as those used for cellular telephony, distort the radiation pattern for satellite services, e.g., GPS, and SDARS, due to coupling and shadowing. However, due to the small size of DAB and cellular telephone antenna masts, this distortion is normally acceptable. On the other hand, larger mast antennas, such as those used for AM and FM radio reception, present significantly more distortion in the radiation patterns for satellite services. Accordingly, larger mast antennas cannot be placed adjacent to satellite antennas.

To address this issue, some conventional solutions incorporate a concentric antenna arrangement. In such an arrangement, a helical antenna for use with satellite services such as GPS and SDARS is arranged concentrically with a mast antenna for reception of terrestrial signals, such as DAB or cellular telephone signals. The helical antenna, which operates at its axial mode, can be constructed using a thin, flexible substrate or a wire wrapped into a cylindrical shape. The cables or wires for the mast antenna are typically routed inside and concentric to the helical antenna. Accordingly, the mast antenna is thicker and more rigid than traditional AM/FM mast antennas. One drawback to this type of design is that the helical antenna cannot be bent along its length. In addition, if the mast antenna needs to be tilted for a particular vehicle application, the helical antenna must also be tilted, potentially resulting in an unacceptable radiation pattern for the helical antenna.

SUMMARY OF VARIOUS EMBODIMENTS

According to various example embodiments, an antenna module incorporates a microstrip patch antenna and a mast antenna in an at least substantially concentric arrangement for communicating signals in multiple communication bands. The output signals from the microstrip patch antenna and the mast antenna are output via a single RF cable.

One embodiment is directed to an antenna arrangement including a mast antenna and a microstrip patch antenna located proximate and at least substantially concentrically with the mast antenna.

Another embodiment is directed to a communication system including a receiver and an antenna arrangement. The antenna arrangement includes a mast antenna and a microstrip patch antenna located proximate and at least substantially concentrically with the mast antenna.

Various embodiments may provide certain advantages. For instance, the antenna module can be used to communicate signals in multiple communication bands, including both satellite and terrestrial communications. The antenna module conserves space, while avoiding unacceptable distortion of radiation patterns for satellite services. In addition, the mast antenna can be implemented using a thinner, more flexible construction than certain conventional solutions. Further, providing the outputs from the antennas via a single RF cable may facilitate collocating tuners for multiple communication services, resulting in considerable size and cost savings by using a single set of RF cables and connectors.

Additional objects, advantages, and features will become apparent from the following description and the claims that follow, considered in conjunction with the accompanying drawings.

DESCRIPTION OF VARIOUS EMBODIMENTS

An antenna module incorporates a microstrip patch antenna and a mast antenna in an at least substantially concentric arrangement for communicating signals in multiple communication bands. The output signals from the microstrip patch antenna and the mast antenna are output via a single RF cable.

In the following description, numerous specific details are set forth in order to provide a thorough understanding of various embodiments of the present invention. It will be apparent to one skilled in the art that various embodiments may be practiced without some or all of these specific details. In other instances, well known components have not been described in detail in order to avoid unnecessarily obscuring the invention.

Figure 1:
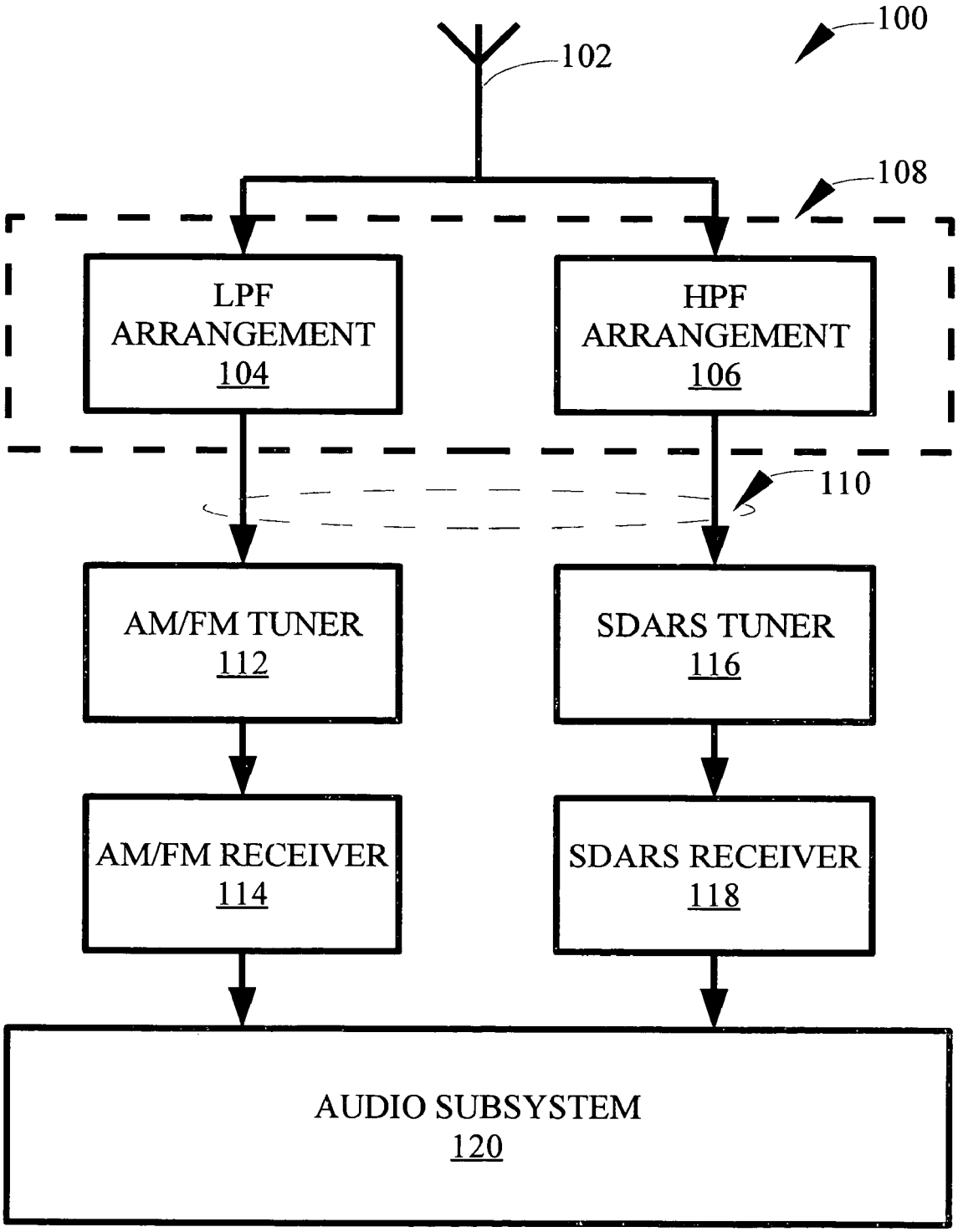
FIG. 1 is a block diagram illustrating an example communication system according to an embodiment.

Referring now to the drawings, FIG. 1 illustrates an example communication system 100, such as a vehicle entertainment system. In the communication system 100, an antenna arrangement 102 receives radio frequency (RF) signals. The RF signals can be received from satellite and terrestrial transmitters. Examples of satellite transmitters include, but are not limited to, satellite digital audio radio service (SDARS) transmitters and global positioning system (GPS) satellites. Terrestrial transmitters can transmit signals in a variety of communication bands, including, but not limited to, an AM communication band, an FM communication band, a digital audio broadcast (DAB) communication band, an advanced mobile phone service (AMPS) cellular telephony communication band, a personal communications services (PCS) cellular telephony communication band, a global system for mobile (GSM) cellular telephony communication band, or an industrial-scientific-medical (ISM) communication band. For purposes of illustration, the antenna arrangement 102 is described as receiving RF signals from an SDARS satellite transmitter and an AM or FM terrestrial transmitter. However, it will be appreciated by those of skill in the art that the principles described herein can be applied to implement other multiband configurations involving satellite and terrestrial transmitters.

The RF signals are conducted from the antenna arrangement 102 to a low pass filter (LPF) arrangement 104 and a high pass filter (HPF) arrangement 106. The LPF arrangement 104 passes the terrestrial signal, e.g., the AM or FM radio signal. The HPF arrangement 106 passes the satellite signal, e.g., the SDARS signal. The LPF arrangement 104 and the HPF arrangement 106 may each be associated with respective amplifiers (not shown), and may be implemented on a single circuit board 108. The output signals generated by the LPF arrangement 104 and the HPF arrangement 106 may be combined as a single output signal using a crossover network and output via a single RF cable 110. In this way, the number of RF connectors required may be reduced, resulting in size and cost savings.

The AM or FM radio signal is conducted to an AM/FM tuner 112 and, in turn, to an AM/FM receiver 114. The SDARS signal is conducted to an SDARS tuner 116 and, in turn, to an SDARS tuner 118. In the embodiment illustrated in FIG. 1, the antenna arrangement 102 is operatively coupled to the AM/FM receiver 114 and the SDARS receiver 118 through the AM/FM tuner 112 and the SDARS tuner 116, respectively. It will be appreciated by those skilled in the art that the antenna arrangement 102 can be operatively coupled to multiple communication devices. Some such communication devices may have both transmitting and receiving capabilities, and may be connected to antennas, such as transmitting antennas, other than the antenna arrangement 102. If the antenna arrangement 102 is located in a vehicle having multiple communication devices, the communication devices may be operatively coupled to the antenna via a high-speed data bus (not shown). The communication devices may include, e.g., one or more receivers in combination with one or more transmitters.

The AM/FM receiver 114 and the SDARS receiver 118 are operatively coupled to an audio subsystem 120, which may include a number of speakers. For some services, the receiver may be operatively coupled to the audio subsystem 120 through one or more intermediate devices. For example, the SDARS receiver 118 may be operatively coupled to the audio subsystem 120 through a decoder (not shown), which decodes the RF signals received by the SDARS receiver 118. In addition, the decoder may also perform an authentication function to verify that the communication system 100 is authorized to receive programming embodied in the RF signal. The decoded signal may contain audio and video components.

Figure 2:
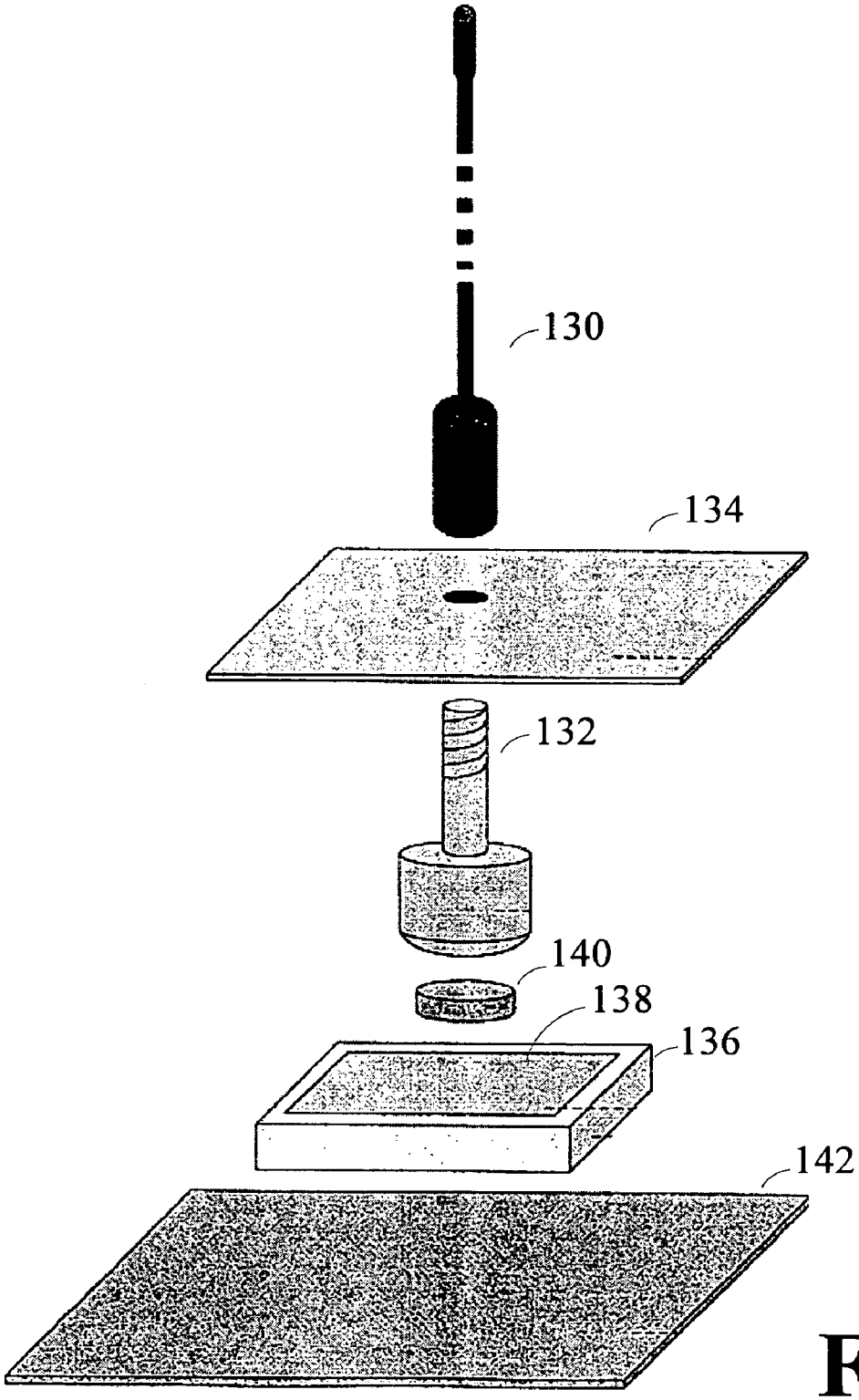
FIG. 2 is an exploded view of an example antenna arrangement forming part of the communication system illustrated in FIG. 1.
Figure 3:
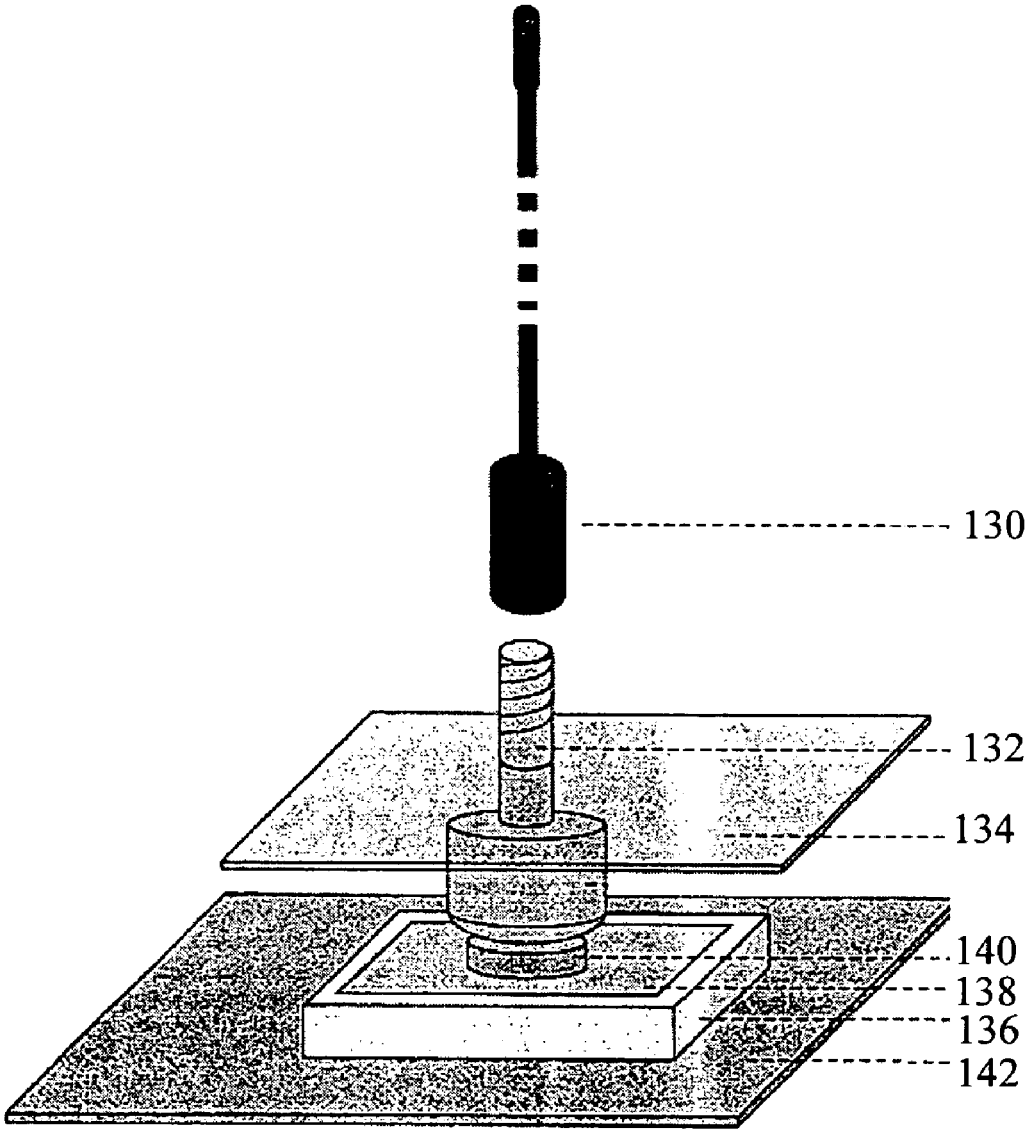
FIG. 3 is an assembled view of the antenna arrangement illustrated in FIG. 2.

FIG. 2 is an exploded view of an example implementation of the antenna arrangement 102. FIG. 3 is an assembled view of the implementation of the antenna arrangement 102 shown in the exploded view of FIG. 2. A mast antenna 130 is configured to receive terrestrial RF signals, for example, in the AM or FM communication band. Alternatively, the mast antenna 130 can be configured to receive and/or transmit terrestrial RF signals in other communication bands, including, but not limited to, the DAB, AMPS, PCS, GSM, and ISM communication bands. The mast antenna 130 is mounted on a metal stud 132 that extends through a plastic cover 134. A portion of the metal stud 132 that extends from the plastic cover 134 is threaded to facilitate mounting the mast antenna 130. In some embodiments, a portion of the metal stud 132 that is located under the plastic cover 134 is convex. This convex shape facilitates insertion of the metal stud 132 into the plastic cover 134 at a variety of angles, thereby allowing the mast antenna 130 to be tilted.

A microstrip patch antenna is formed by a dielectric layer 136 and a conductive layer 138 formed proximate a top side of the dielectric layer 136. The microstrip patch antenna is located proximate and at least substantially concentrically with the mast antenna 130.

An elastomeric conductive pad 140 electrically connects the conductive layer 138 of the microstrip patch antenna to the metal stud 132 when the plastic cover 134 is attached. The elastomeric conductive pad 140 is attached to either the conductive layer 138 of the microstrip patch antenna or the metal stud 132 using an adhesive during manufacturing. Attaching the plastic cover 134 compresses the elastomeric conductive pad 140, establishing the electrical connection between the conductive layer 138 of the microstrip patch antenna and the metal stud 132.

A patch feed pin (not shown) is connected to a circuit board 142 that contains, for example, the LPF arrangement 104 and the HPF arrangement 106 of FIG. 1. The signal from the patch feed pin is connected to the input of the AM/FM tuner 112 of FIG. 1 through the LPF arrangement 104. The signal from the patch feed pin is also connected to the input of the SDARS tuner 116 of FIG. 1 through the HPF arrangement 106. The insertion loss of the HPF arrangement 106 is very small and does not significantly affect the noise figure of the SDARS system.

The implementation of the antenna arrangement 102 shown in FIGS. 2 and 3 may offer certain advantages. For example, the elastomeric conductive pad 140 provides mechanical isolation between the antenna mast 130 and the circuit board 142 to improve durability of the antenna arrangement 102 during shock and vibration.

In addition, the influence of the mast antenna 130 on the microstrip patch antenna is reduced relative to antennas that are placed side-by-side for a number of reasons. First, the voltage at the center of the conductive layer 138, where the mast antenna 130 is connected, is at a minimum. Further, the mast antenna 130 has a high impedance at SDARS frequencies and can be considered open. With the mast antenna 130 at least substantially concentric with the microstrip patch antenna, shadowing and electrical coupling between the mast antenna 130 and the microstrip patch antenna is minimized. As a result, the axial ratio and efficiency are improved. Moreover, attaching the mast antenna 130 to the circuit board 142 does not require forming a hole in the dielectric layer 136 of the microstrip patch antenna or using a separate feed pin. As a result, the dielectric layer 136 remains homogeneous, and the mast feed pin and the patch feed pin are decoupled.

Figure 4:
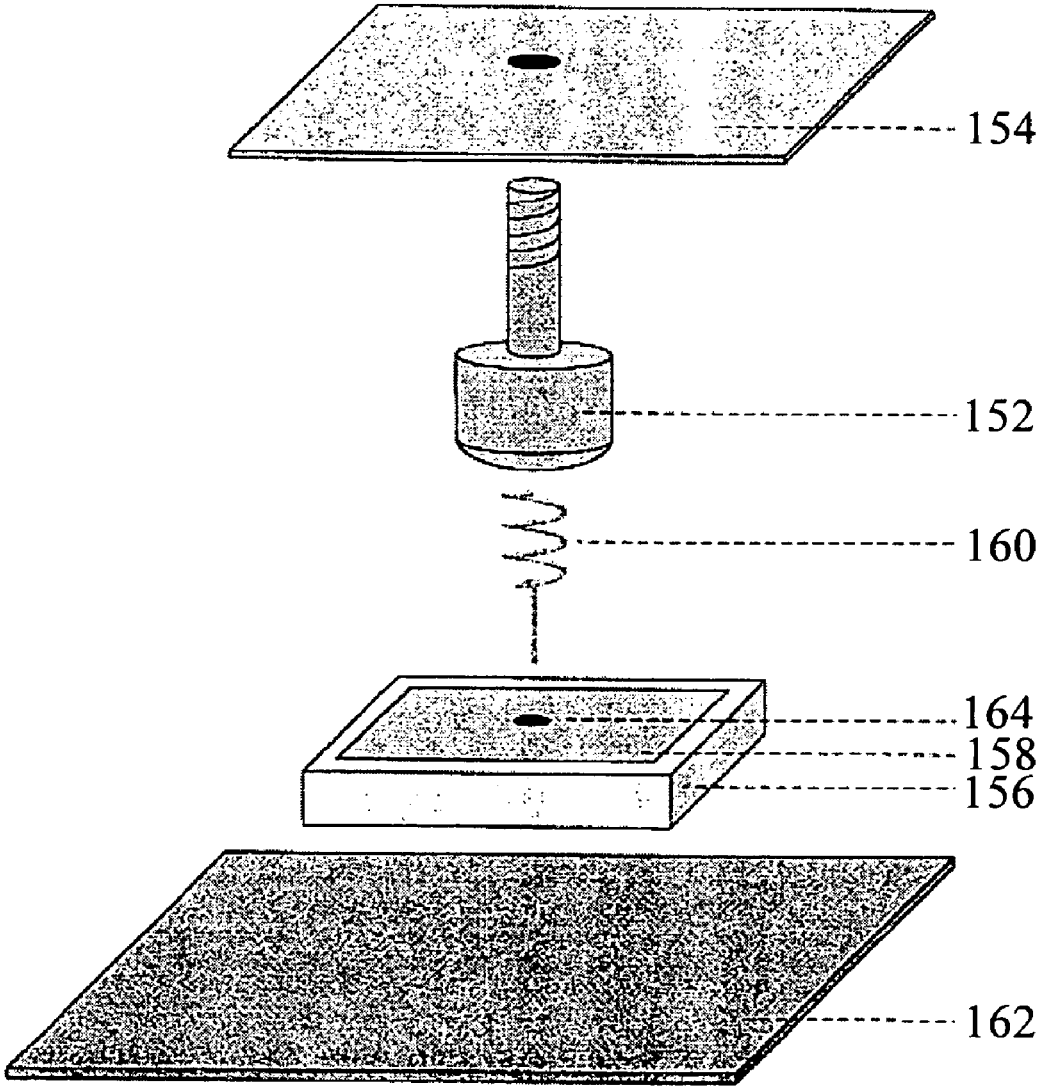
FIG. 4 is an exploded view of another example antenna arrangement forming part of the communication system illustrated in FIG. 1.
Figure 5:
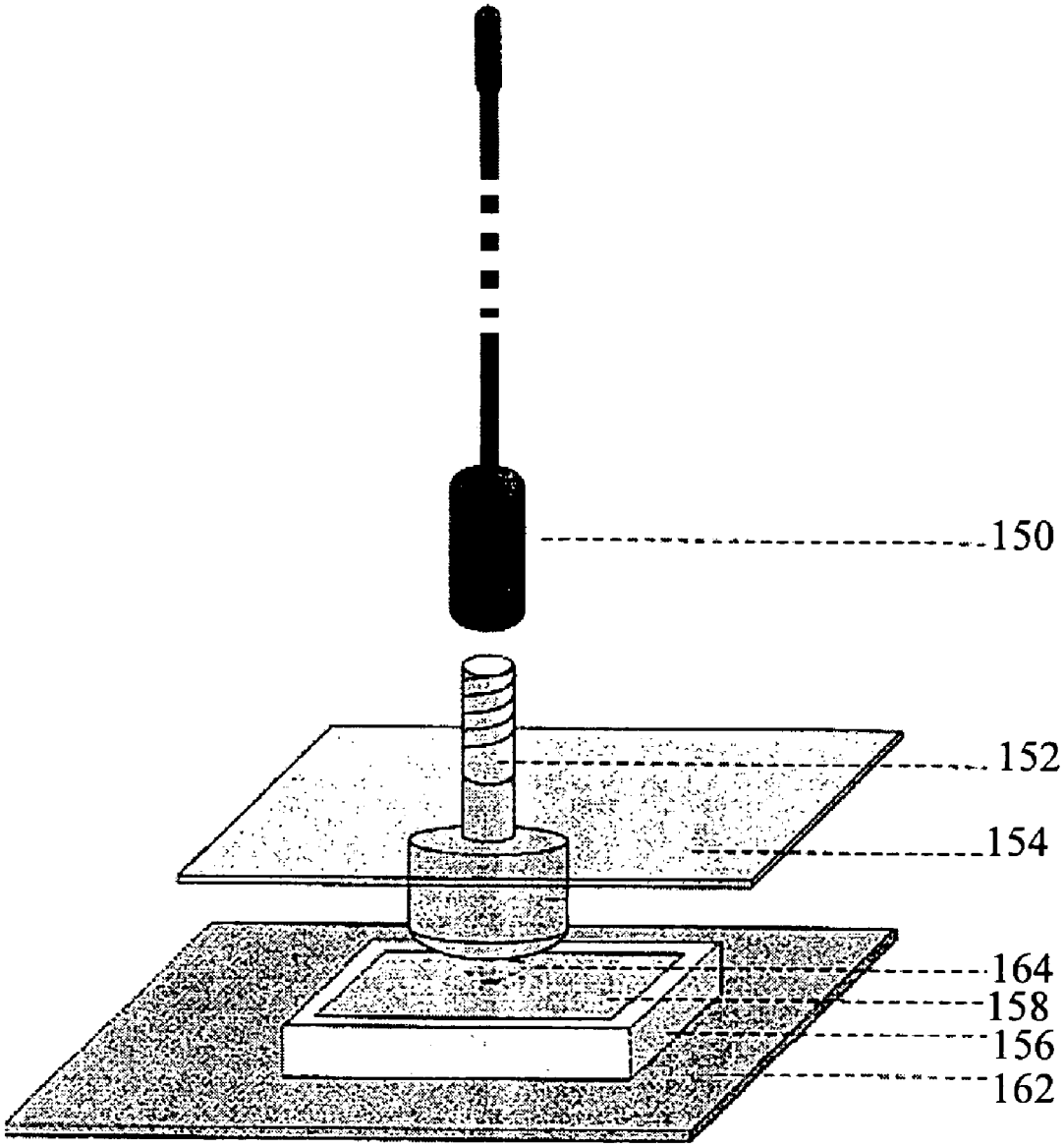
FIG. 5 is an assembled view of the antenna arrangement illustrated in FIG. 4.

FIG. 4 is an exploded view of another example implementation of the antenna arrangement 102. FIG. 5 is an assembled view of the implementation of the antenna arrangement 102 shown in the exploded view of FIG. 4. A mast antenna 150 is configured to receive terrestrial RF signals, for example, in the AM or FM communication band. Alternatively, the mast antenna 150 can be configured to receive and/or transmit terrestrial RF signals in other communication bands, including, but not limited to, the DAB, AMPS, PCS, GSM, and ISM communication bands. The mast antenna 150 is mounted on a metal stud 152 that extends through a plastic cover 154. A portion of the metal stud 152 that extends from the plastic cover 154 is threaded to facilitate mounting the mast antenna 150. In some embodiments, a portion of the metal stud 152 that is located under the plastic cover 154 is convex. This convex shape facilitates insertion of the metal stud 152 into the plastic cover 154 at a variety of angles, thereby allowing the mast antenna 150 to be tilted.

A microstrip patch antenna is formed by a dielectric layer 156 and a conductive layer 158 formed proximate a top side of the dielectric layer 156. The microstrip patch antenna is located proximate and at least substantially concentrically with the mast antenna 150.

When the plastic cover 154 is attached, a spring pin 160 electrically connects the metal stud 152 to a circuit board 162 that contains, for example, the LPF arrangement 104 and the HPF arrangement 106 of FIG. 1. The spring pin 160 is soldered to the circuit board 162 and extends through a hole 164 formed in the dielectric layer 156 and the conductive layer 158 of the microstrip patch antenna. Attaching the plastic cover 154 compresses the spring pin 160, establishing the electrical connection between the metal stud 152 (and therefore the antenna mast 150) and the circuit board 162.

A patch feed pin (not shown) is connected to the circuit board 162. The signal from the patch feed pin is connected to the input of the SDARS tuner 116 of FIG. 1 through the HPF arrangement 106. The signal from the spring pin 160 is connected to the input of the AM/FM tuner 112 of FIG. 1 through the LPF arrangement 104. The AM/FM and SDARS circuits are separate in the implementation shown in FIGS. 4 and 5.

The implementation of the antenna arrangement 102 shown in FIGS. 4 and 5 may offer certain advantages. For example, the spring pin 160 provides mechanical isolation between the antenna mast 150 and the circuit board 162 to improve durability of the antenna arrangement 102 during shock and vibration.

In addition, the influence of the mast antenna 150 on the microstrip patch antenna is reduced relative to antennas that are placed side-by-side for a number of reasons. First, the voltage at the center of the conductive layer 158, where the mast antenna 150 is connected, is at a minimum. Further, the mast antenna 150 has a high impedance at SDARS frequencies and can be considered open. With the mast antenna 150 at least substantially concentric with the microstrip patch antenna, shadowing and electrical coupling between the mast antenna 150 and the microstrip patch antenna is minimized. As a result, the axial ratio and efficiency are improved. In addition, in the implementation shown in FIGS. 4 and 5, the AM/FM and SDARS circuits remain isolated from one another, reducing the need for filtering between the circuits.

As demonstrated by the foregoing discussion, various embodiments may provide certain advantages. For instance, the antenna module can be used to communicate signals in multiple communication bands, including both satellite and terrestrial communications. The antenna module conserves space, while avoiding unacceptable distortion of radiation patterns for satellite services. In addition, the mast antenna can be implemented using a thinner, more flexible construction than certain conventional solutions. Further, providing the outputs from the antennas via a single RF cable may facilitate collocating tuners for multiple communication services, resulting in considerable size and cost savings by using a single set of RF cables and connectors.

It will be understood by those skilled in the art that various modifications and improvements may be made without departing from the spirit and scope of the disclosed embodiments. The scope of protection afforded is to be determined solely by the claims and by the breadth of interpretation allowed by law.

What is claimed is:

1. An antenna arrangement comprising:

a mast antenna for receiving a first electromagnetic signal at a first radio freguency;

a microstrip patch antenna for receiving a second electromagnetic signal at a second radio freguency higher than the first radio freguency, the microstrip patch antenna being located proximately below and at least substantially concentrically with the mast antenna, the mast antenna being positioned completely above the microstrip patch antenna and further being in electrical communication therewith for common output of the first and second signals from the microstrip patch antenna in a single output feed.

2. The antenna arrangement of claim 1, further comprising:

a low pass filter arrangement operatively coupled to the single feed and configured to selectively pass the first signal; and a high pass filter arrangement operatively coupled to the single feed and configured to selectively pass the second signal.

3. The antenna arrangement of claim 1, further comprising a resilient, electrically conducting member above the microstrip patch antenna providing the electrical communication between the mast antenna and the microstrip patch antenna.

4. The antenna arrangement of claim 3, wherein the resilient electrically conducting member is an elastomeric conductive pad.

5. The antenna arrangement of claim 1, wherein the mast antenna is configured to communicate a signal in an AM communication band, an FM communication band, a digital audio broadcast (DAB) communication band, an advanced mobile phone service (AMPS) cellular telephony communication band, a personal communications services (PCS) cellular telephony communication band, a global system for mobile (GSM) cellular telephony communication band, or an industrial-scientific-medical (ISM) communication band.

6. The antenna arrangement of claim 1, wherein the microstrip patch antenna is configured to communicate a signal in a satellite digital audio radio service (SDARS) communication band or a global positioning system (GPS) communication band.

7. The communication system of claim 1, wherein the microstrip patch antenna has no opening therethrough coaxial with the mast antenna.

8. A communication system comprising:

a receiver; and an antenna arrangement comprising a mast antenna for receiving a first electromagnetic signal at a first radio freguency, a microstrip patch antenna for receiving a second electromagnetic signal at a second radio freguency higher than the first radio frequency, the microstrip patch antenna being located proximately below and at least substantially concentrically and in electrical communication with the mast antenna, the mast antenna being positioned completely above the microstrip patch antenna and further being in electrical communication therewith for common output of the first and second signals from the microstrip patch antenna in a single output feed.

9. The communication system of claim 8, further comprising:

a low pass filter arrangement operatively coupled to the single feed and configured to selectively pass the a first output signal; and a high pass filter arrangement operatively coupled to the single feed and configured to selectively pass the second signal.

10. The communication system of claim 8, further comprising a resilient, electrically conducting member providing the electrical communication between the mast antenna and the microstrip patch antenna.

11. The communication system of claim 10, wherein the resilient electrically conducting member is an elastomeric conductive pad.

12. The communication system of claim 8, wherein the mast antenna is configured to communicate a signal in an AM communication band, an FM communication band, a digital audio broadcast (DAB) communication band, an advanced mobile phone service (AMPS) cellular telephony communication band, a personal communications services (PCS) cellular telephony communication band, a global system for mobile (GSM) cellular telephony communication band, or an industrial-scientific-medical (ISM) communication band.

13. The communication system of claim 8, wherein the microstrip patch antenna is configured to communicate a signal in a satellite digital audio radio service (SDARS) communication band or a global positioning system (GPS) communication band.

14. The communication system of claim 8, wherein the microstrip patch antenna has no opening therethrough coaxial with the mast antenna.

* * * * *